United States Patent [19]

Cruz

[11] Patent Number: 4,773,642

[45] Date of Patent: Sep. 27, 1988

[54] ADJUSTABLE EXERCISE WEIGHT SUPPORTING DEVICE

[76] Inventor: Raynaldo T. Cruz, P.O. Box 1030, Westerly, R.I. 02891

[21] Appl. No.: 929,646

[22] Filed: Nov. 12, 1986

[51] Int. Cl.[4] ..... A63B 13/00

[52] U.S. Cl. ..... 272/123; 248/354.5

[58] Field of Search ..... 272/62, 63, 103, 93, 272/117, 118, 122, 123, 134, 144, DIG. 4, 70, 70.3, 70.4; 248/352, 354, 354.5

[56] References Cited

U.S. PATENT DOCUMENTS

| | | | |
|---|---|---|---|
| 2,989,114 | 6/1961 | Ecroyd | 272/70 X |
| 3,235,255 | 2/1966 | Leflar | 272/123 |
| 3,268,224 | 8/1966 | Freshour | 272/117 |
| 3,394,932 | 7/1968 | Leflar | 272/103 |
| 4,129,916 | 12/1978 | Schlesinger | 272/62 X |
| 4,205,838 | 6/1980 | McIntosh | 272/123 |
| 4,302,009 | 11/1981 | Johnson | 272/123 |
| 4,306,715 | 12/1981 | Sutherland | 272/117 |
| 4,368,884 | 1/1983 | Colvin | 272/123 |
| 4,411,425 | 10/1983 | Milnar | 272/123 |
| 4,477,074 | 10/1984 | Bushnell | 272/123 |
| 4,479,634 | 10/1984 | Blatz | 248/354.5 X |
| 4,641,837 | 2/1987 | Ruth | 272/123 |
| 4,666,150 | 5/1987 | Segrist et al. | 272/123 |
| 4,711,449 | 12/1987 | Ochab | 272/123 |

FOREIGN PATENT DOCUMENTS

| | | | |
|---|---|---|---|
| 3423837 | 1/1986 | Fed. Rep. of Germany | 272/134 |

*Primary Examiner*—Richard J. Apley
*Assistant Examiner*—Robert W. Bahr
*Attorney, Agent, or Firm*—Charles H. Thomas

[57] ABSTRACT

An exercise weight supporting device is provided to accommodate both dumbbells and barbells. The weight supporting device includes a stand with a base having a pair of horizontally disposed L-shaped feet arranged in mirror image fashion relative to each other and having first extremities spaced from each other to evenly support exercise weights. A pair of parallel inclined standards rise at an angle of about 60 degrees from the second, proximate extremities of the feet of the base and extend upwardly between the first extremities of the feet. A brace extending transversely between the standards holds the standards and the feet in rigid orientation relative to a pair of support arms that engage the standards in telescoping fashion and are longitudinally positionable relative thereto. The device is able to accommodate barbells as well as dumbbells, and may be adjusted in height to allow a user to lift weights from supine, seated or standing positions.

6 Claims, 2 Drawing Sheets

FIG.1
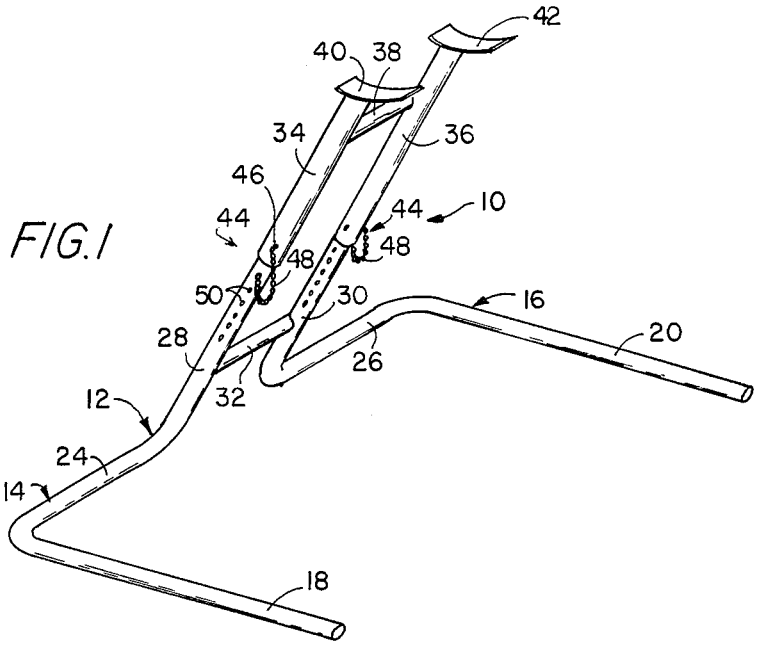
FIG.3
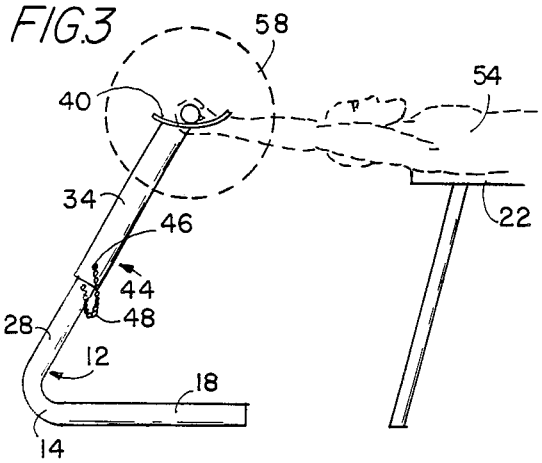
FIG.4
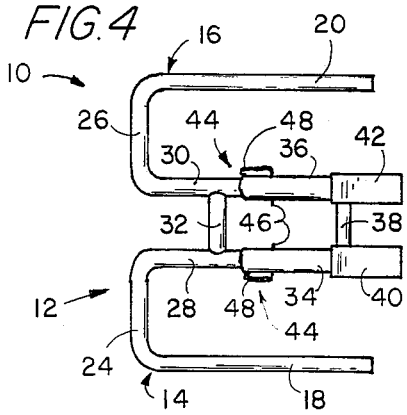
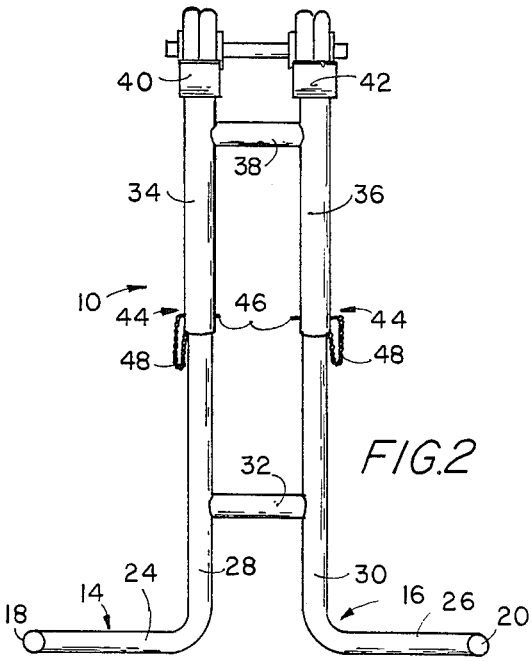
FIG.2

ADJUSTABLE EXERCISE WEIGHT SUPPORTING DEVICE

BACKGROUND OF THE INVENTION

1. Field of the Invention

The present invention relates to an exercise weight support device which may be utilized to alternatively support both dumbbells and barbells.

2. Description of the Prior Art

Various exercise weight supporting devices have been utilized by individuals seeking to engage in muscular exercises by lifting barbells and dumbbells. Exemplary devices of this type are described in U.S. Pat. Nos. 4,205,838; 4,368,884; 4,411,425; and 4,477,074. Nevertheless, despite the availablity of such prior art devices, injuries such as back strains, shoulder strains and other similar types of upper body injuries result from lifting weights, particularly during an initial lift. To minimize the likelihood of such injuries the individual performing the exercises may seek the aid of a "spotter" to guide him in the return of the weights to their supports.

SUMMARY OF THE INVENTION

The present invention is a device for supporting exercise weights comprising a stand having a base formed with a pair of L-shaped horizontal stabilizing feet which are disposed in mirror image arrangement and which have proximal ends that converge toward a pair of inclined standards which rise parallel to each other from the proximal feet ends at an angle of about 60 degrees from horizontal. An adjustable weight support assembly is provided having a pair of parallel support arms at the upper extremity of each of which there is a cradle adapted to carry an exercising weight. The support arms are coupled together by transverse support brace means. The lower extremities of the support arms coact in telescoping fashion with the inclined standards. Height adjustment means are provided for releaseably locking the support arms relative to the upright standards.

One principal objective of the present invention is the provision of a mechanical substitute for a "spotter" during an individual's performance of a variety of weight lifting exercises. In conventional practice, a "spotter" is an individual who aids a person who is exercising with weights by informing the individual performing the exercises of the movements which are needed to accurately place weights back upon a support once the weights have been lifted. With guidance from a spotter, an individual performing weight lifting exercises is less likely to experience muscle strains due to misjudgments in replacing weights upon weight support stands. However, oftentimes the services of a weight spotter are unavailable, so that an individual is either forced to forego the weight lifting exercises altogether, or accept an increased hazzard of muscle and back strains.

The exercise weight supporting device of the invention provides a base with a pair of stablilizing feet which are adapted to evenly support exercise weights, and also a pair of inclined, parallel standards which rise at an angle of about 60 degrees relative to the horizontal and between the stabilizing feet of the base. By providing inclined standards in this fashion, the weight cradles are positioned in view of the weight lifter, thereby providing a mechanical substitute for a spotter. The individual performing the exercises is able to easily view the positions of the weight cradles without assistance, and is thereby less likely to make miscalculated muscular movements which can result in back or muscle injury. Also, since the weight cradles are carried between the stabilizing feet of the base, the weights are less likely to fall backward from the cradles when the individual performing the exercises slaps the weights onto the cradles.

The cradles are preferably carried approximately five inches in spaced separation for each other by supporting arms. This distance is ideal for the placement of dumbbells, since the weights on each side of the connecting rod respectively rest on the weight cradles. The same spacing is also sufficient to support the rod of a barbell in adequately stable fashion.

The weight supporting device of the invention is extremely versatile in that the heights of the weight cradles may be adjusted to accommodate exercises performed from supine, seated and standing positions. Preferably, the inclined standards are approximately 34 inches in length and the support arms are both 20 inches long. Diametrically aligned apertures are defined through the structures of both of the support arms approximately two inches from the lower extremities of the supporting arms. Both the inclined standards and the support arms are tubular structures, and the support arms fit coaxially about the standards in telescoping arrangement therewith. Pairs of diametrically aligned openings are defined through the inclined standards beginning about 2 inches from the upper extremities thereof. The openings through the inclined standards are spaced approximately 2 inches apart. Where seven sets of such openings are formed, the support arms can be moved through a range of approximately 14 inches so that locking pins may be transversely inserted through the apertures in the support arms as they are moved into longitudinal alignment with selected openings in the inclined standards.

The invention may be described with greater clarity and particularity by reference to the accompanying drawings.

DESCRIPTION OF THE DRAWINGS

FIG. 1 is a perspective view of preferred embodiment of the exercise weight supporting device of the invention.

FIG. 2 is an elevational view of the weight supporting device of FIG. 1 viewed from the position of a weight lifting bench used therewith.

FIG. 3 is a side elevational view of the weight supporting device of FIG. 1 showing one manner in which it may be used to support barbell weights.

FIG. 4 is a top plan view of the weight supporting device of FIG. 1.

DESCRIPTION OF THE EMBODIMENT

Figure 5:
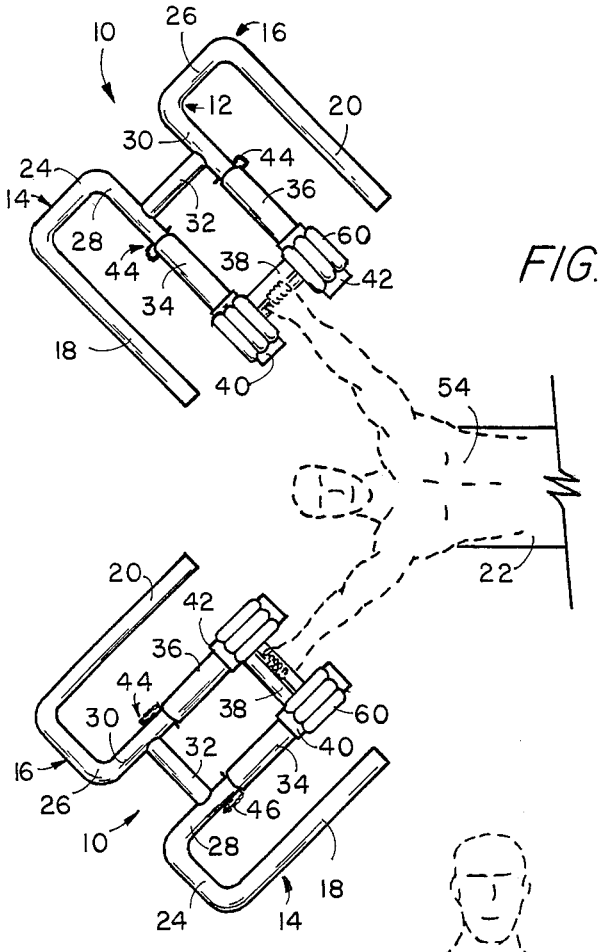
FIG. 5 is a top plan view showing one manner of use of a pair of the weight supporting devices of FIG. 1 to support sets of dumbbells.

FIG. 1 illustrates an exercise weight supporting device indicated generally at 10 used to support a pair of separated weights on a dumbbell or to support a barbell. The weight supporting device 10 is comprised of a stand 12 formed of tubular stainless steel having a wall thickness of about three-sixteenths of an inch and an outer diameter of about one and one-half inches. The base of the stand has a pair of horizontally disposed, L-shaped feet 14 and 16. The feet 14 and 16 are disposed in mirror image arrangement, as best illustrated in FIGS. 1 and 4. The feet 14 and 16 both have first extremities 18 and 20, respectively, which are about twenty-five inches long and which reside parallel to each other, spaced apart a distance of approximately twenty-eight inches so as to evenly support sets of weights. The second, or proximal extremities of the feet 14 and 16 are indicated at 24 and 26, respectively, and are axially aligned and converge toward each other and toward a pair of parallel tubular inclined standards 28 and 30. The standards 28 and 30 rise at an inclination of about 60 degrees relative to the horizontal feet 14 and 16 and between the parallel ends 18 and 20 thereof. A transverse, tubular standard brace 32, best depicted in FIGS. 2 and 4, is welded to both of the standards 28 and 30 to connect them together and to hold the extremities 18 and 20 of the feet 14 and 16 at a fixed, spaced separation from each other.

A pair of tubular steel support arms 34 and 36 coact with the standards 28 and 30, respectively, in telescoping fashion. A transverse support brace 38, best depicted in FIGS. 2 and 4 holds the support arms 34 and 36 parallel to each other. A pair of weight cradles 40 and 42 are mounted at the upper extremities of the support arms 34 and 36, respectively. A height adjustment means 44 is provided to releaseably lock the support arms 34 and 36 at a selected longitudinal position along the standards 28 and 30.

The height adjustment means 44 include a pair of linear steel latch or locking pins 46 of three-eighths inches in diameter which pass perpendicularly and diametrically through both the inclined standards 28 and 30 and the support arms 34 and 36 to releaseably and longitudinally immobilize the support arms 34 and 36 relative to the standards 28 and 30. The latch pins 46 are secured by short lengths of chain 48 to the lower ends of the support arms 34 and 36. The latch pins 46 pass through pairs of transverse diametrically opposed apertures defined in opposite sides of the support arms 34 and 36 approximately two inches above the lower extremities of the support arms.

The inclined standards 28 and 30 each have pairs of diametrically opposed and longitudinally aligned openings 50 defined transversely therethrough. The openings 50 in each pair are aligned with each other and are longitudinally alignable with the apertures through the support arms 34 and 36 so as to allow the latch pins 46 to pass completely through the support arms 34 and 36 and through the standards 28 and 30, which are respectively located coaxially therewithin, as best illustrated in FIGS. 2 and 4.

The weight cradles 40 and 42 are formed as curved strips of metal each about one inch wide and formed over an arc of approximately 80 degrees. The cradles 40 and 42 are disposed in abutment across the tops of the support arms 34 and 36, respectively, and are welded thereto.

FIG. 3 illustrates one manner of use of a single weight supporting device 10 with a set of barbells, indicated at 58. As illustrated, a weight lifting bench 22 is located between and longitudinally displaced from the feet 14 and 16 of the device 10, so that the portions 18 and 20 of the feet 14 and 16 are parallel to the bench 22. For height adjustment the support brace 38 is grasped and lifted slightly to facilitate withdrawal of the releaseable latch pins 46. The support arms 34 and 36 are then moved together longitudinally along the standards 28 and 30 until the desired openings 50 are aligned with the apertures through the support arms 34 and 36 to position the weight cradles 40 and 42 at the desired height. The releaseable latch pins 46 are then reinserted to pass entirely through the support arms 34 and 36 and the standards 28 and 30 therewithin, in the manner illustrated in FIGS. 2 and 4.

As illustrated in FIG. 3, a user, indicated at 54, in a supine position on the exercise bench 22, and desirous of performing exercises using a set of barbells 58, with his head tilted back is able to clearly see the weight support cradles 40 and 42. The user 54 is able to grasp the set of barbells 58 therefrom, perform the appropriate exercises, and return the barbells 58 to a position seated atop the cradles 40 and 42 of a single supporting device 10 with a minimal danger of back or muscle strain. The inclined standards 28 and 30, and the extensions thereof formed by the support arms 34 and 36, hold the cradles 40 and 42 at very visible, convenient positions.

Utilizing the invention, a user is able to clearly see the weight cradles 40 and 42, so that the services of a spotter are not necessary. If the user wishes to perform exercises from a seated or standing position, he will undoubtedly choose to reposition the support arms 34 and 36 longitudinally along the inclined standards 28 and 30 by withdrawing and reinserting the latch pins 46 in the manner previously described. Adjustment in this fashion may also be performed to accommodate different physical statures and arm lengths of users performing weight lifting exercises.

Figure 6:
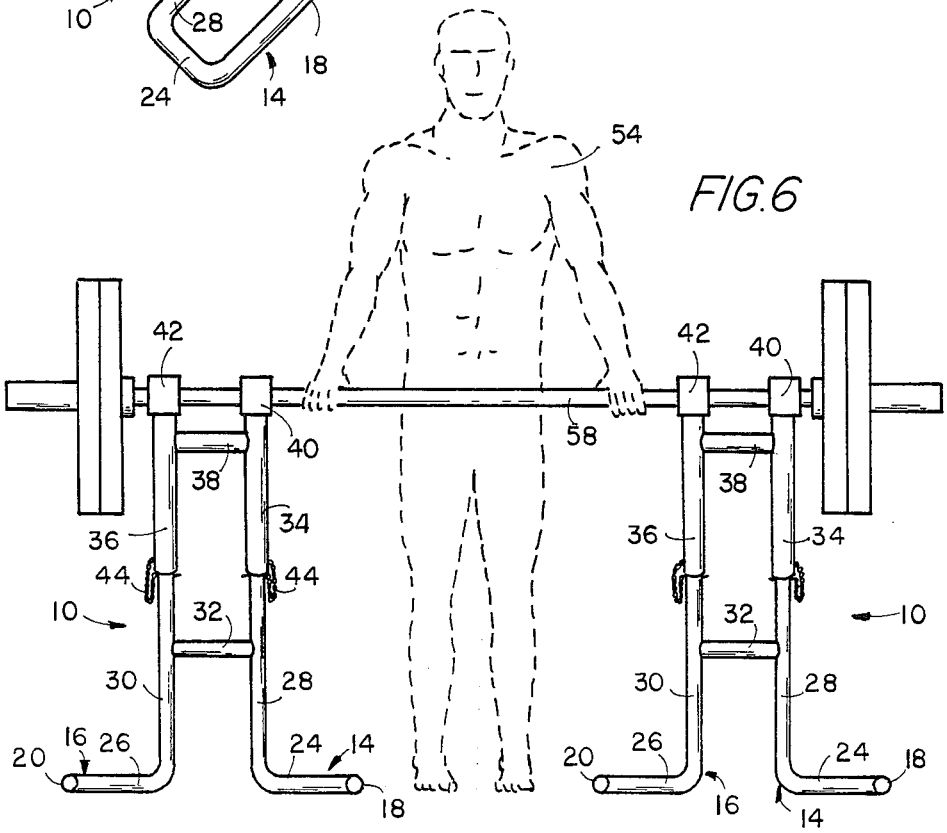
FIG. 6 is an elevational view showing another manner of use of a pair of weight supporting devices of FIG. 1 to support barball weights.

The exercise weight supporting device 10 of the invention may be utilized in pairs, for example, as depicted in FIGS. 5 and 6. FIG. 5 illustrates the use of a pair of exercise weight supporting devices 10 to support separate sets of dumbbells 60, one for each arm. The weights on the dumbbell 60 are spaced apart to allow the user 54 to grip the axial connecting rod with one hand. The weights of the dumbbell 60 on the opposite ends of each connecting rod rest upon the weight cradles 40 and 42, as illustrated. The height of the weight cradles 40 and 42 may be readily adjusted in the manner previously described to the comfort of the user 54. The user 54 may then conveniently perform exercises to build biceps and pectoral muscles by lifting and replacing the dumbbell sets 60 upon the weight supporting devices 10 in the manner depicted in FIG. 5.

FIG. 6 illustrates another manner in which a pair of weight supporting devices 10 are utilized to support a barbell 58 for lifting from a standing position by a user 54. The weight supporting devices 10 are spaced longitudinally apart between the weights at both ends of the barbell 58. The exercise weight supporting device 10 may be used singly or in pairs in numerous other ways to support exercise weights.

Undoubtedly, numerous variations and modifications of the invention will become readily apparent to those familiar with supports for weights that are utilized with weight lifting exercises. Accordingly, the scope of the invention should not be construed as limited to the specific embodiment depicted and described, but rather is defined in the claims appended hereto.

I claim:

1. A free standing device for supporting exercise weights independently of a weight lifting bench comprising a stand having a base formed with a pair of L-shaped horizontal stabilizing feed which are disposed in mirror image arrangement and which have proximal ends that converge toward a pair of inclined standards which rise parallel to each other from said proximal feet ends at an angle of about 60 degrees from horizontal, an adjustable weight support assembly having a pair of parallel support arms, at the upper extremity of each of which there is a cradle adapted to carry an exercising weight, transverse support brace means which rigidly couples and holds said cradles apart a spaced distance such that each of said cradles is adapted to respectively receive a separate one of two weights each of which is located at an opposite end of an axial connecting rod of a dumbbell and, to admit a user's hand between said cradles to grip an axial connecting rod of a dumbbell between said separate weights and between said cradles and wherein the lower extremities of said support arms coact in telescoping fashion with said inclined standards, and height adjustment means for releasably locking said support arms relative to said inclined standards.

2. A device for supporting exercise weights according to claim 1 wherein said lower extremities of said support arms each have transverse apertures therethrough and said inclined standards each have a plurality of transverse, spaced openings therein selectively longitudinally alignable with said apertures in said support arms, and said height adjustment means includes a pair of locking pins which fit into said apertures in said support arms and selectively aligned openings in said inclined standards to support said cradles at a selected elevation.

3. A free standing exercise weight suporting device comprising a stand positionable independently of a weight lifting bench and including a base having a pair of horizontally disposed feet with first extremities oriented in spaced separation from each other and which have second proximal extremities which converge toward each other and toward a pair of parallel standards that rise at an inclination of about 60 degrees relative to said feet, a transverse standard brace which connects said standards together and which holds said first extremities of said feet in spaced separation from each other, a pair of weight cradle means, a pair of support arms which each respectively support a single one of said weight cradle means and which coact with said standards in telescoping fasion, transverse support brace means extending between said support arms to hold said support arms parallel to each other and to hold said weight cradles apart a spaced distance such that each of said weight cradles is adapted to respectively receive a single one of two speparate weights each of which is located at an opposite end of an axial connecting rod of a dumbbell and to admit a user's hand between said cradles to grip an axial connecting rod of a dumbbell between said separate weights thereon, and adjustment means for releasably locking said support arms at a selected longitudinal position along said standards.

4. An exercise weight supporting device according to claim 3 wherein said support arms fit coaxially about said standards and include transverse latch pin receiving apertures therein, and each of said standards includes a plurality of spaced openings therein longitudinally alignable with said latch pin receiving apertures, and said support arms are provided with latch pins which fit into said latch pin receiving apertures and into openings in said standards aligned wherewith to longitudinally immobilize said support arms relative to said standards.

5. An exercise weight supporting device according to claim 3 wherein said transverse support brace means holds said cradles approximately five inches in spaced separation from each other.

6. A free standing device for supporting exercise weights independently of a weight lifting bench comprising a stand with a base having a pair of horizontally disposed feet having first parallel extremities spaced from each other, and second proximate extremities from which a pair of parallel standards rise at an angle of about 60 degrees relative to said feet and between said first extremities thereof, standard brace means extending transversely between said standards to hold said standards and said feet in rigid orientation relative to each other, a pair of weight cradles, a pair of support arms which each carry a single one of said weight cradles at the upper extremity thereof, and transverse support arm brace means which holds said weight cradles apart a spaced distance such that each of said weight cradles is adapted to respectively receive a single one of two separate weights each of which is located at an opposite end of an axial connecting rod of a dumbbell and to admit a user's hand between said cradle to grip an axial connecting rod of said dumbbell between the aforesaid weights thereon, and wherein said transverse support arm brace means rigidly joins and holds said support arms parallel to each other and in telescoping and longitudinally adjustable fashion relative to said standards, and height adjustment means for releasably and longitudinally immobilizing said support arms relative to said standards.

* * * * *